US009500030B2

(12) United States Patent
Pursimo et al.

(10) Patent No.: US 9,500,030 B2
(45) Date of Patent: Nov. 22, 2016

(54) ROCK DRILLING APPARATUS AND METHOD FOR CONTROLLING THE ORIENTATION OF THE FEED BEAM

(71) Applicant: SANDVIK MINING AND CONSTRUCTION OY, Tampere (FI)

(72) Inventors: Juha Pursimo, Tampere (FI); Sami Hanski, Tampere (FI); Juha Lassila, Tampere (FI); Tuomo Pirinen, Tampere (FI); Jari Talasniemi, Tampere (FI)

(73) Assignee: SANDVIK MINING & CONSTRUCTION OY, Tampere (FI)

( * ) Notice: Subject to any disclaimer, the term of this patent is extended or adjusted under 35 U.S.C. 154(b) by 500 days.

(21) Appl. No.: 14/060,711

(22) Filed: Oct. 23, 2013

(65) Prior Publication Data

US 2014/0110139 A1 Apr. 24, 2014

(30) Foreign Application Priority Data

Oct. 24, 2012 (EP) ..... 12189760

(51) Int. Cl.
*E21B 7/02* (2006.01)

(52) U.S. Cl.
CPC ..... *E21B 7/022* (2013.01); *E21B 7/025* (2013.01)

(58) Field of Classification Search
CPC ..... E21B 7/022; E21B 19/08; E21B 7/025
USPC ..... 173/1, 4, 31, 36, 38, 193, 8, 9, 11; 175/24, 40
See application file for complete search history.

(56) References Cited

U.S. PATENT DOCUMENTS

| | | | | |
|---|---|---|---|---|
| 3,724,559 | A | 4/1973 | Stromnes | |
| 4,508,035 | A * | 4/1985 | Mashimo | E21B 7/022 102/312 |
| 4,698,570 | A * | 10/1987 | Satoh | G05B 19/404 173/193 |
| 4,712,624 | A * | 12/1987 | Mashimo | G01C 7/06 173/193 |
| 4,848,485 | A * | 7/1989 | Piipponen | E21B 44/00 173/13 |
| 7,681,660 | B2 * | 3/2010 | Muona | E21B 7/022 173/1 |
| 2010/0044107 | A1 * | 2/2010 | Keskinen | E21D 9/006 175/24 |

FOREIGN PATENT DOCUMENTS

| | | |
|---|---|---|
| CN | 1039465 | 2/1990 |
| GB | 2103969 A | 3/1983 |
| GB | 2219230 A | 12/1989 |
| WO | 2010029220 A1 | 9/2009 |
| WO | 2012072870 A1 | 6/2012 |

* cited by examiner

*Primary Examiner* — Nathaniel Chukwurah
(74) *Attorney, Agent, or Firm* — Corinne R. Gorski

(57) ABSTRACT

A rock drilling apparatus and method for controlling the orientation of a feed beam of a rock drilling apparatus including a carrier, a drilling boom attached at a first end to the carrier, a feed beam attached turnably to a second end of the drilling boom, a drilling unit attached movably along the feed beam, and a support attached to the feed beam for supporting the drilling boom on the ground. The orientation of the boom and feed beam are adjusted to compensate for the orientation change caused by driving the support onto the ground.

12 Claims, 6 Drawing Sheets

ROCK DRILLING APPARATUS AND METHOD FOR CONTROLLING THE ORIENTATION OF THE FEED BEAM

RELATED APPLICATION DATA

This application claims priority under 35 U.S.C. §119 to EP Patent Application No. 12189760.7, filed on Oct. 24, 2012, which the entirety thereof is incorporated herein by reference.

SUMMARY

The present disclosure relates to a rock drilling apparatus comprising a carrier, a drilling boom attached at a first end to the carrier, a feed beam attached turnably to a second end of the drilling boom, a drilling unit attached movably along the feed beam, and a support attached to the feed beam for supporting the drilling boom onto the ground. The apparatus includes an arrangement for controlling the orientation of the boom and feed beam.

Further, a method for controlling the orientation of a feed beam of a rock drilling apparatus including a carrier, a drilling boom attached at a first end to the carrier, a feed beam attached turnably to a second end of the drilling boom, a drilling unit attached movably along the feed beam, and a support attached to the feed beam for supporting the drilling boom on the ground, is provided.

BACKGROUND

Rock drilling apparatuses normally comprise a carrier onto which a boom at its one end has been turnably assembled in vertical and horizontal directions in relation to the carrier. Further, at the other end of the boom there is a feed beam for a rock drill. At the front end of the feed beam there is typically a support, which is pressed against the surface before drilling in order to keep the feed beam steadily in its position during the drilling.

Typically, the feed beam is orientated before pushing the support against the surface to its designed direction so that the hole should be drilled according to a predesigned plan precisely where the designer has intended to. However, there may remain errors in the drilling. Deviations in the orientation are due to physical facts, which apply as the support is pushed against the surface and after that.

When pushing the support against the surface, the force pushing the feed beam against the rock may change the position and the alignment of the apparatus, which changes the direction of the boom and the feed beam. Also, the forces may bend the boom, which may further increase the deviation. As a result, the directions of the holes may be incorrect.

An aspect of the disclosure is to provide a rock drilling apparatus and a method for controlling the orientation of the feed beam, in which the accuracy of the drilling is improved.

The basic idea in the rock drilling apparatus is that the arrangement is configured, on the basis of the parameters affecting the orientation, to define the orientation change caused by driving the support onto the ground. The orientation of the boom and feed beam is automatically adjusted before applying drilling force to compensate for the orientation change caused by supporting the drilling boom onto the ground.

In one embodiment of the rock drilling apparatus, the apparatus is configured to define the orientation change on the basis of one or more of the orientation of the boom, orientation of the feed beam, direction of the hole, and direction and inclination of the carrier.

In another embodiment of the rock drilling apparatus, the apparatus is configured, on the basis of the defined orientation change, to automatically change the orientation of the boom and feed beam before the support is driven onto the ground.

In still another embodiment of the rock drilling apparatus, the apparatus is configured, on the basis of the defined orientation change, to automatically change the orientation of the boom and feed beam after the support is driven onto the ground.

In still another embodiment of the rock drilling apparatus, the apparatus is configured, on the basis of the defined orientation change, to automatically change the orientation of the boom and feed beam during the driving of the support onto the ground.

Further, the method includes the steps of defining the orientation of the boom and feed beam, defining, on the basis of parameters affecting the orientation change, the orientation change caused by driving the support to the ground, and adjusting automatically the orientation of the boom and feed beam to compensate for the orientation change before applying drilling force.

In one embodiment of the method, the defining of the orientation change is performed on the basis of one or more of the orientation of the boom, orientation of the feed beam, direction of the hole, and direction and inclination of the carrier.

In another embodiment of the method, the orientation change is done on the basis of parameters defining the changes of the positions of the carrier, boom, and feed beam, when the rock drilling apparatus is set to a support position for drilling after having driven the support into the ground.

In still another embodiment of the method, the adjustment of the orientation of the boom and feed beam is done before driving the support into the ground.

In still another embodiment of the method, the adjustment of the orientation of the boom and feed beam is done during the driving of the support onto the ground.

In yet another embodiment of the method, the orientation is done by using the drilling data of the hole to be drilled.

BRIEF DESCRIPTION OF THE FIGURES

Some embodiments of the invention will be described in a more detailed manner below by referring to the enclosed drawings, in which.

DETAILED DESCRIPTION OF THE INVENTION

Figure 1A:
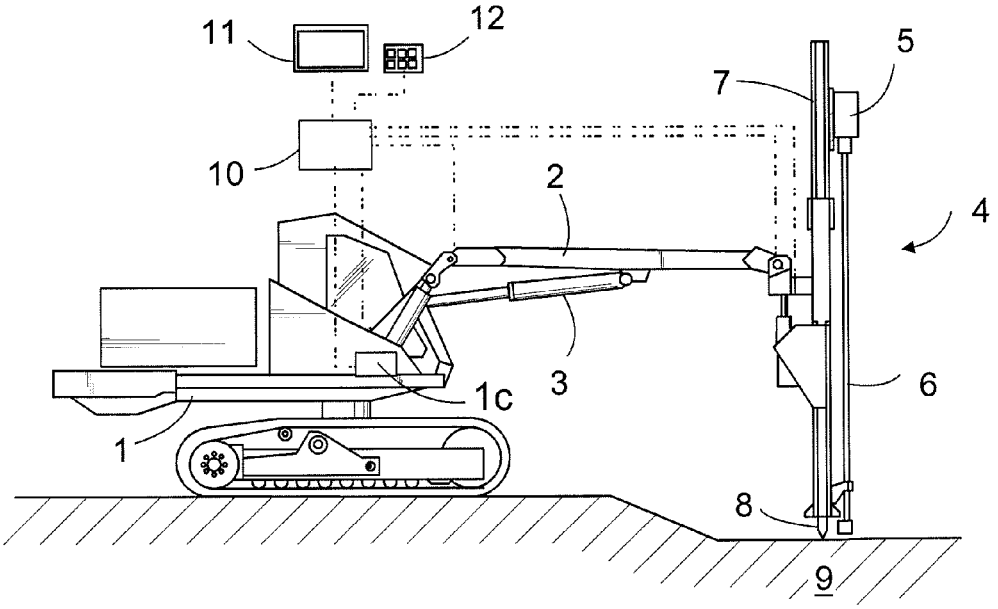
FIG. 1*a* shows schematically a rock drilling apparatus in a side view.

FIG. 1 shows schematically a rock drilling apparatus in a side view. The rock drilling apparatus has a movably carrier 1 with tracks 1*a* onto which a boom 2 with actuators 3 is attached at its one end. The rock drilling apparatus may also have a cabin 1*b*. A rock drilling unit 4 is attached to the other end of the boom 2. The rock drilling unit 4 includes a rock drill 5 with a drill string 6 with a drill bit 6*a* which are assembled movably to a feed beam 7 in its longitudinal direction.

At the front end of the feed beam there is a support 8 which is pushed against the ground 9 before drilling. The support 8 may be a separate element attached to the feed beam or it may be a solid part of the feed beam or any solution known in the art. The feed beam 7 may be attached to the end of the boom 2 turnably in several ways. The boom may be attached to the carrier immovably or it may be connected to the carries with one or more joints that enable turning of the boom in relation to the carrier in different directions. The boom may be of any known type, such as a boom having a single boom part attached at one end to the carrier of the apparatus and a feed beam attached to the other end of the boom part, a swivel boom having two or more boom parts with joints connecting the boom parts together, a telescopic boom or any other known boom type.

The construction of the rock drilling apparatus may be defined as a kinematic model, on the basis of which the behavior of the apparatus can be calculated. This kinematic model may be used to define the deviations from the intended orientation of the feed beam caused push of the support against the ground and, thus, also the preset values for controlling the boom and/or the feed beam to compensate the deviation.

The apparatus has commonly known carrier sensors 1*c* known to one skilled in the art for sensing the position and inclinations of the carrier in relation to the earth coordinate system.

The operation and construction of the carrier, boom, actuators, drilling unit and feed beam are commonly known to one skilled in the art and the details of the construction and the operation need not be explained more specifically.

Further, the rock drilling apparatus has a control unit 10 including a computer, which controls the operation of the equipment. The control unit 10 is connected to sensors that sense, for instance, the turning angles or orientations or positions of different parts of the boom and the connection with the feed beam and the carrier or the boom and the feed beam. This is shown schematically by dashed lines in FIG. 1*a*. Further, the rock drilling apparatus typically has a display 11 and a control panel 12, which are schematically shown in FIG. 1*a*. In practice, the computer, display and control panel or different kinds of controls may have been attached inside a cabin 1*a*, where the operator of the drilling apparatus is normally situated. The carrier sensors are also connected to the control unit 10.

The control unit 10 also has memory means, such as a normal memory of a computer, for storing data and code for controlling the control unit and the drilling apparatus to perform at least some of the support compensation features further illustrated below. The data may include separate tables or charts including data about the changes of positions and orientations in relation to the construction of the carrier, boom, actuators, drilling unit and feed beam and their positions in relation to each other. For clarity FIGS. 1*b* and 3*a*-4*b* only show the feed beam without the usual pieces of equipment, such as the rock drill, drill string, etc.

Figure 1B:
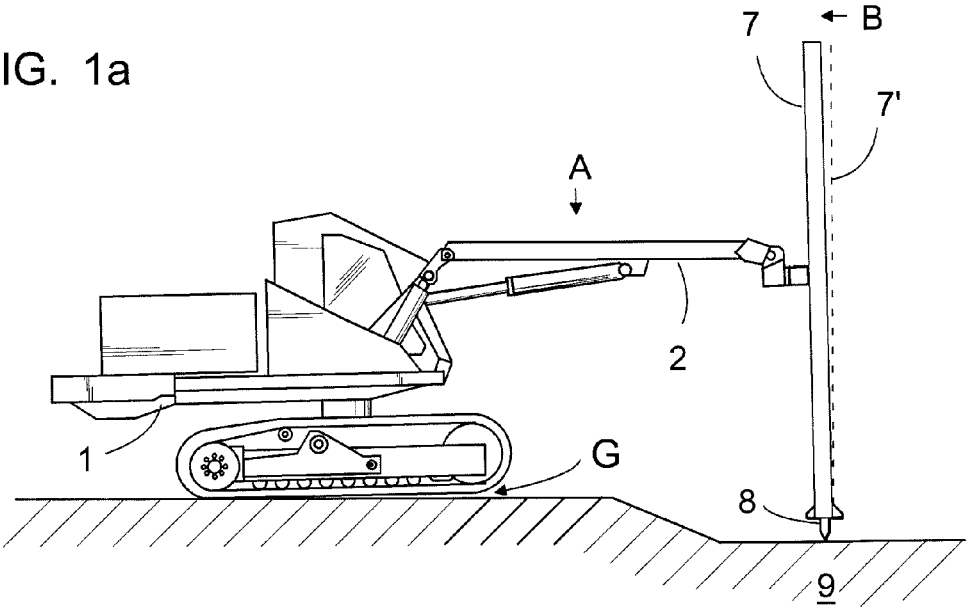
FIG. 1*b* shows schematically the rock drilling apparatus in a side view after the support has been pushed against the surface.

FIG. 1*b* shows schematically a rock drilling apparatus in a side view, illustrating how the direction of the feed beam and thus the drilling direction change when the support 8 is pressed against the ground 9. FIG. 1*b* further shows how the boom 2 tilts towards the carrier because of the force pushing the support 8 against the ground 9.

When the feed beam 7 is pushed against the ground 9, the support 8 may enter into the ground or, if the ground is hard, such as solid rock, the support remains against the surface. When the pushing force pushes the feed beam in relation to the boom 2 downwards, the boom 2 may change its position and orientation from its original form, which is shown with the dashed line 2'. Correspondingly the feed beam 7 may change its position and orientation as shown with arrow B, and its direction deviates from the desired direction shown by a dashed line 7'.

At the same time, the front parts of the tracks 1*a* are lifted upwards so that a gap G is easily produced. When this happens, the apparatus is turned upwards in relation to the rear end of the tracks and, as a result, the feed beam is tilted towards a carrier 1.

This is the simplest situation when the ground below the rock drilling apparatus is solid and substantially smooth so that the carrier does not tilt sideways. In other circumstances where the ground is uneven and partly or entirely soft changes in the direction of the feed beam are more complicated. However, if the ground is inclined but solid, the inclination of the boom during the supporting may be estimated or calculated. In this case the experience of previous drillings may be used.

Figure 2A:
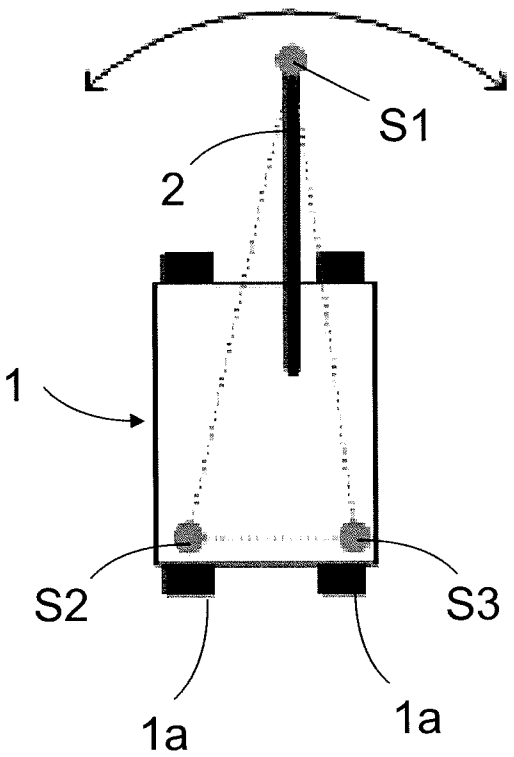
FIGS. 2*a*-2*c* show schematically the rock drilling apparatus seen from above showing the support triangle in different positions of the boom.
Figure 2B:
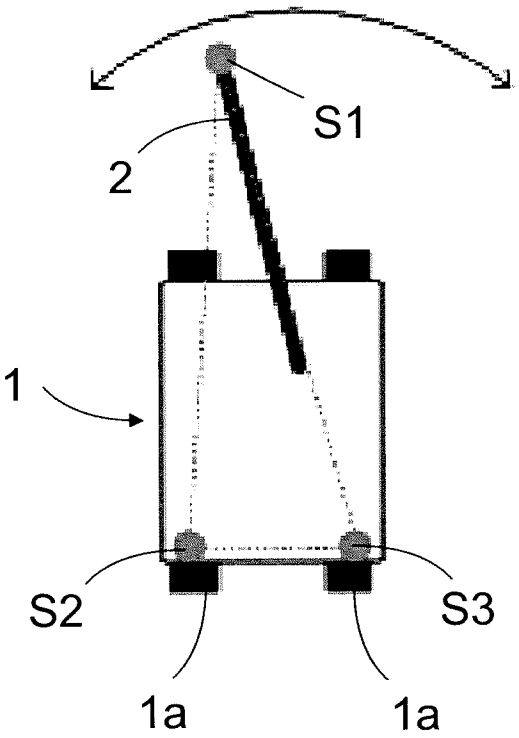
Figure 2C:
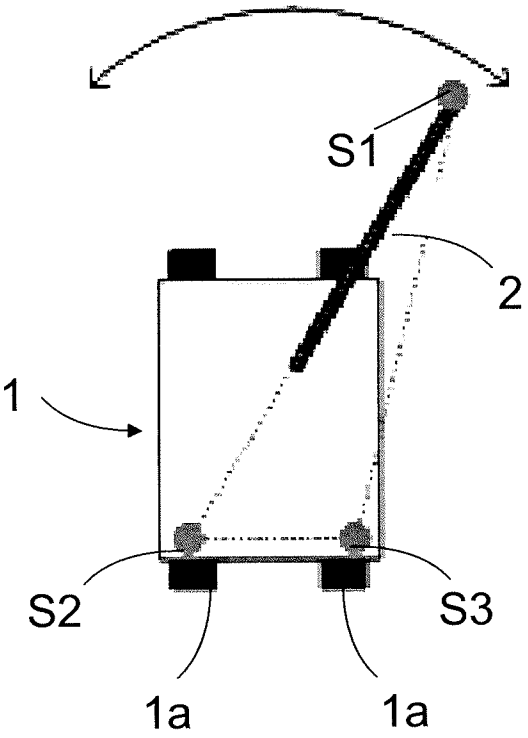

FIGS. 2*a*-2*c* show schematically the rock drilling apparatus seen from above, showing the support triangle in different positions of the boom. In this presentation, as an example the carrier is not turnable in relation to the tracks 1*a*, but boom 2 is turnable in relation to the carrier. The same, however, applies to cases where the carrier is turnable in relation to the tracks.

In FIG. 2*a* the boom is aligned with the longitudinal direction of the rock drilling apparatus. When the support in the feed beam is pushed against the ground and the front ends of the tracks 1*a* are lifted from the ground, there is formed a support triangle, the support points of which are formed of the support point of the feed beam S1, and the points S2 and S3 where the rear ends of the tracks 1*a* are in contact with the ground. In this position, the change in the direction of the feed beam is an inclination towards the carrier 1.

FIG. 2*b* shows a situation in which the boom 2 is turned to the left in relation to the carrier 1. Here the support point S1 of the support in the feed beam has also been moved to the left and the form of the support triangle is changed. In this situation, the feed beam tilts not only towards the carrier but also in the transverse direction of the carrier to the right, which makes the calculation of the change and the compensation more complicated.

FIG. 2*c* further shows a situation in which the boom 2 is turned to the right in relation to the carrier. Again the support point S1 has been moved to the right in relation to the carrier 1 and the support triangle has been changed. In this situation the, feed beam tilts again during the supporting in the longitudinal direction of the carrier and in the transverse direction of the carrier to the left, which is contrary to what happens in the situation of FIG. 2*b*.

The situations in FIGS. 2*a*-2*c* show what happens when the rock drilling apparatus is on a substantially smooth solid ground. If the ground below the carrier is uneven, the carrier may tilt to different directions, which makes the compensation in advance quite difficult and it may be necessary to have extra compensation during the pushing of the support in the feed beam against the ground or even one or more separate compensation steps after pushing the support onto the ground.

Figure 3A:
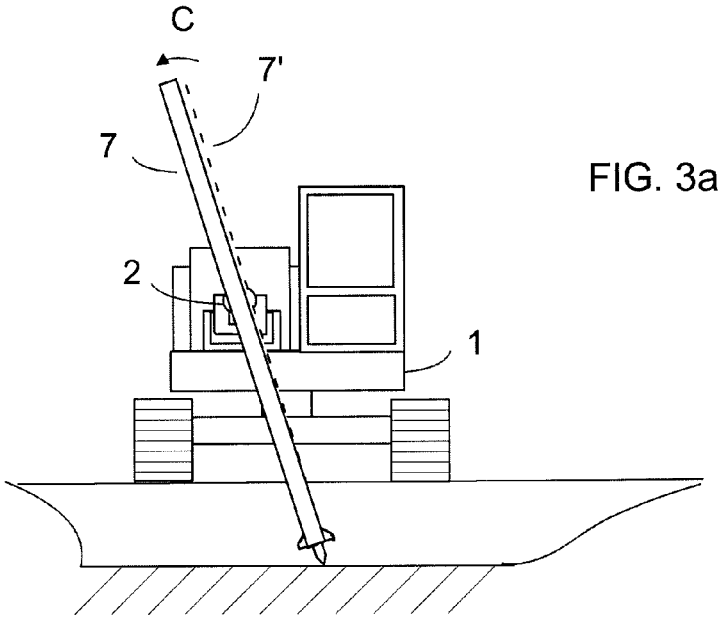
FIG. 3*a* shows schematically the rock drilling apparatus in a side view when adjusted to compensate for a deformation before the support has been pushed against the surface.

FIG. 3*a* shows schematically the rock drilling apparatus seen from the front after the support has been pushed against the ground. When pushing the feed beam 7 towards the ground, the pushing causes a force which tries to turn the feed beam 7 to the left in FIG. 2*a*. As a result, the feed beam 7 turns to a position deviating from the desired position marked with a dashed line 7".

Figure 3B:
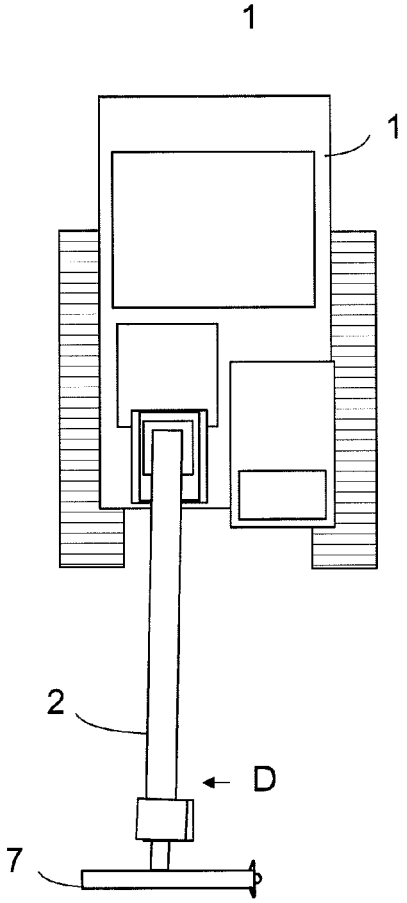
FIG. 3*b* shows schematically the rock drilling apparatus seen from the front when adjusted to compensate the position change before the support has been pushed against the surface.

FIG. 3*b* shows schematically the rock drilling apparatus of FIG. 2*a* seen from above after the support has been pushed against the surface and also the carrier. In this figure it can be seen how the boom 2 has been turned so that the inclination of the feed beam deviates from its desired position marked with a dashed line 2" because of a transverse force D.

One important reason for the changes of the position and orientation is the fact that when the support 8 is pushed against the ground, the front of the carrier is normally lifted upwards at least to some extent. Another reason is that, if the ground under the carrier is uneven, the carrier may tilt in different ways, which causes more deviation. Also the inclination and direction of the hole to be drilled in relation to the carrier have a major influence.

Figure 4A:
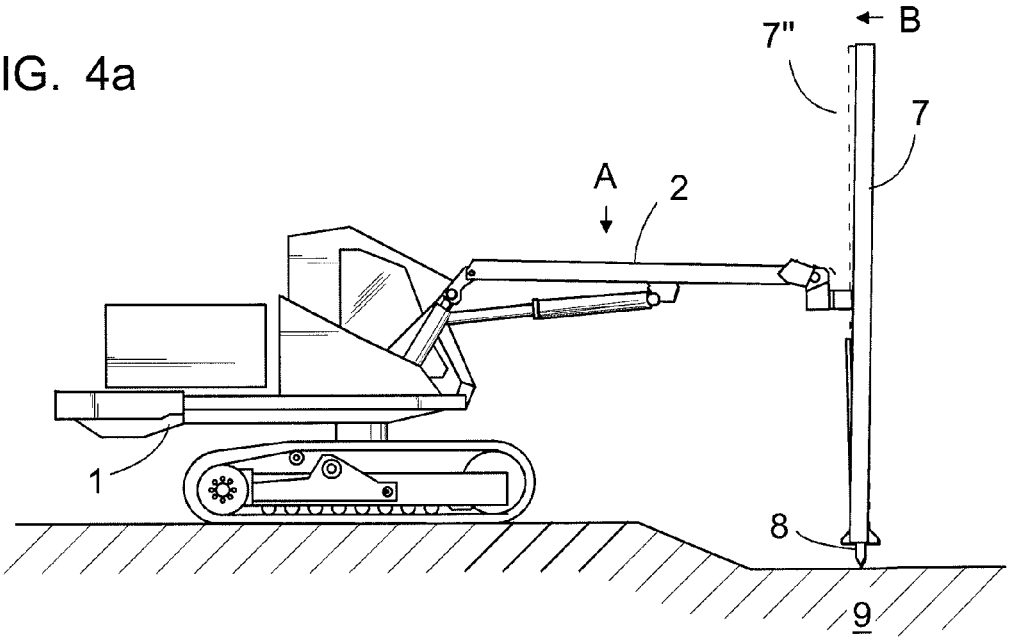
FIG. 4*a* shows schematically the rock drilling apparatus in a side view when adjusted to compensate for deviation.

FIG. 4*a* shows schematically the rock drilling apparatus in a side view when adjusted to compensate for the deviation before the support has been pushed against the surface with drilling force F. As can be seen from the figure the feed beam 7 is turned away from the rock drilling apparatus so that it deviates from the designed orientation shown with a dashed line 7'". When the feed beam is pushed against the ground 9 with the supporting force, the orientation of the carrier and boom 2 change so that at the end the feed beam 7 is in line with the position 7'".

Figure 4B:
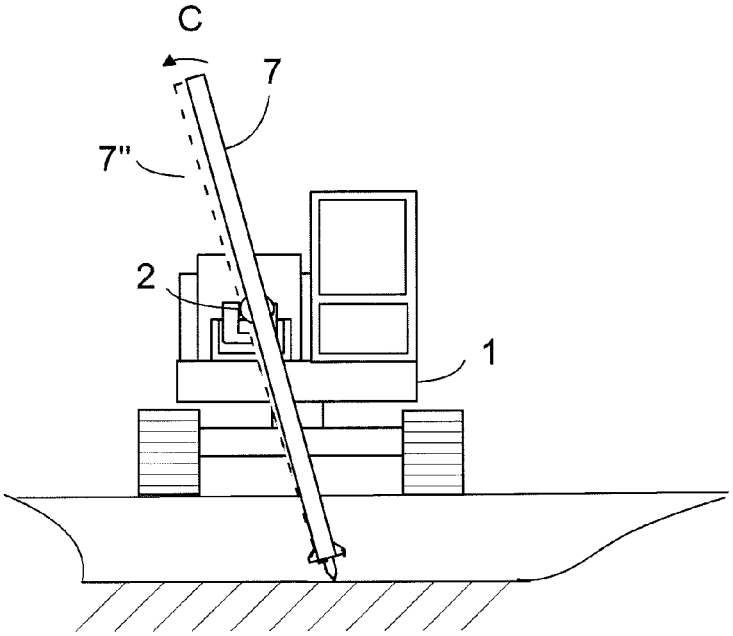
FIG. 4*b* shows schematically the rock drilling apparatus seen from the front when adjusted to compensate for deviation.

FIG. 4*b* shows schematically the rock drilling apparatus seen from the front when adjusted to compensate for the deviation before the support has been pushed against the surface with drilling force F. Again in this figure, the feed beam 7 is turned to the right from the designed position which is marked with a dashed line 7"". When the support 8 of the feed beam 7 is pushed against the ground 9 with drilling force F, the feed beam 7 turns as the arrow C shows and settles to the designed orientation 7"".

The compensation may basically be done in various ways. According to an embodiment, the control units is arranged to perform an automatically preset compensation procedure. Thus, after the position of the rock drilling apparatus and the position and direction of the hole to be drilled have been defined, the control unit defines the necessary compensation, presets the boom and the feed beam into the calculated positions and directions and then pushes the support in the feed beam against the ground. The required compensation may be defined on the basis of the current input parameters (such as the orientation of the boom, orientation of the feed beam, direction of the hole, direction of the carrier, and/or inclination of the carrier) by calculating or retrieving from the memory required new position/orientation of the feed beam and/or boom. If the accuracy of the direction of the feed beam is within preset angle limits, the drilling of the hole may be started. This has been presented in FIGS. 5*a*-5*c*.

Figure 5A:
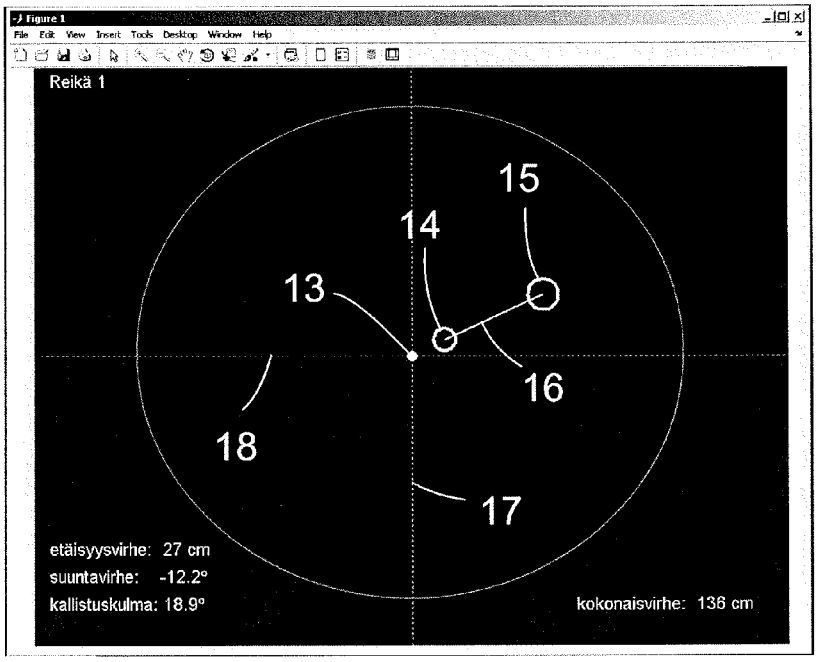
FIGS. 5*a*-5*c* show the screen of the boom positioning and aligning view/display in different operation phases.

FIG. 5*a* presents the screen 11 of the boom positioning and aligning display. In the middle it shows in a dot 13 which presents the position of the hole. A smaller circle 14 presents the drill bit 6*a* of the drill string 6 and a bigger circle 15 the other end of the drill string 6. Between the circles there is a straight line 16 representing the drill string. A vertical line 17 presents the longitudinal direction of the rock drilling apparatus and a horizontal line 18 presents the transverse direction of the rock drilling apparatus.

Figure 5B:
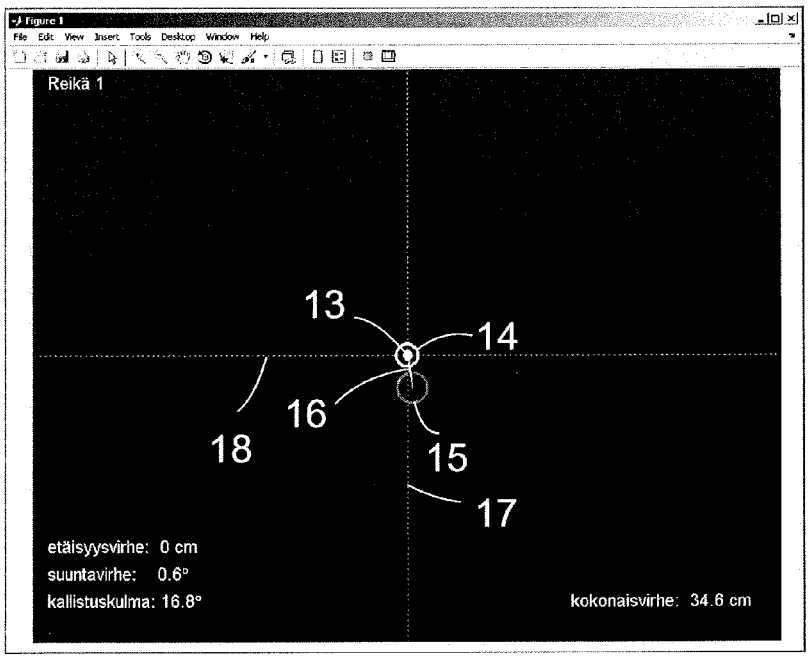

Before starting the drilling, the operator, using the control panel 12 or a touch screen moves the smaller circle 14 onto the dot 13 and starts the presetting. It is also possible that, when starting the presetting, the control unit does this focusing automatically. After starting the presetting, the control unit calculates the necessary preset values, and when these have been calculated, changes the view of the circles. At the same time, the control unit moves the bigger circle 15 and the line 16 according to the calculated values towards the final preset distance and angle. The color of the circles and the line between them may be, e.g. yellow in the beginning, and after the values have been calculated and the position is in accordance with the preset values, their color may change to green, for example. Other colors or different types of lines etc. may be used. This situation is shown in FIG. 5*b*.

Figure 5C:
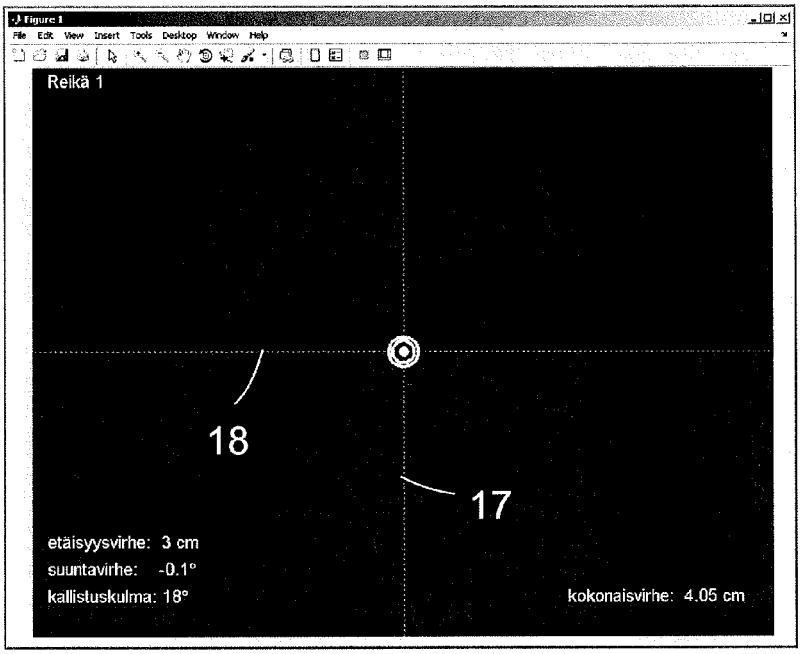

After this phase, the control unit may automatically, or controlled by the operator, start pushing the support against the ground and, if the preset values have been correct, the bigger circle 15 has during the pushing moved onto the smaller circle 13 as shown in FIG. 5*c*. The apparatus may also have a so called "deadman's switch". In this case the operator has to hold this switch all the time during the operation.

In case the direction of the feed beam deviates more than the allowed angle limit, the deviation may be stored in the memory of the control unit and the feed beam is drawn away from the ground. Next, the control unit calculates new preset values taking into account the stored deviation, and the process is repeated by pushing the support in the feed beam against the ground again. It is also possible to use stored data or the experience of the operator from previous drillings.

In another embodiment, the control unit monitors the direction of the feed beam while the support is pushed against the ground and corrects the deviation caused by the pushing of the support (or the already performed deviation) compensation during the pushing and/or after the pushing has ended. This is especially advantageous when the boom is repositioned or redirected to ensure the hole rectitude. Typically, this is done when adding a drill rod or at the start of drilling.

Figure 6:
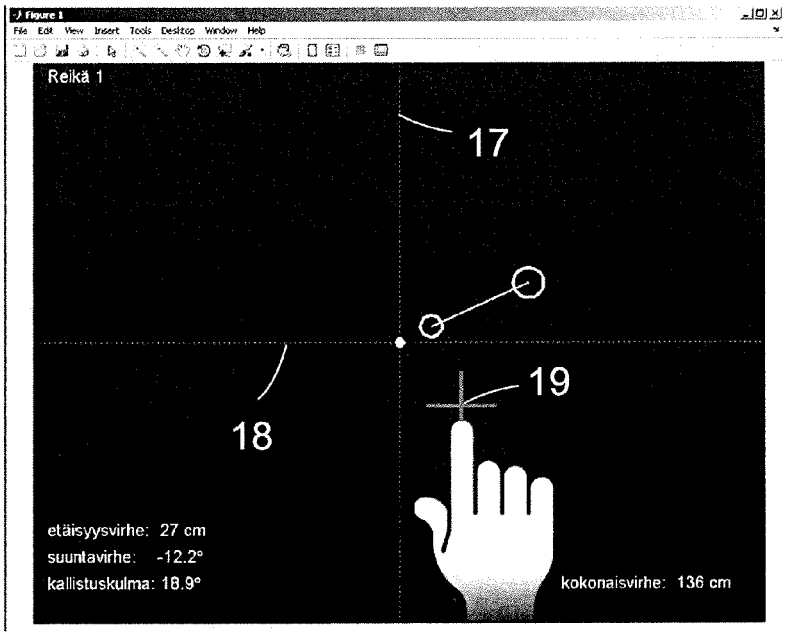
FIG. 6 presents the screen of the boom positioning and aligning view/display when the compensation is done manually.

In a still further embodiment, an indication of compensation for compensating the orientation change caused by driving the support onto the ground is obtained on the basis of an input to a user interface unit from the operator and set as a parameter into the control unit. The control unit calculates the corresponding preset values before starting the pushing of the support towards the ground. This may be applied to cases where the circumstances are such that the automatic presetting might be difficult or time consuming. In this way, the operator uses his or her skills and defines the deviation and needed compensation by using the control panel 12 or a touch screen. This is shown in FIG. 6, in which a cross 19 presents the preset position marked by the operator. The control unit then calculates the necessary preset values as described above. After this, the control unit may automatically, or as controlled by the operator, start pushing the support against the ground such that the compensation, or "advance" is applied, enabling to correctly align the feed beam.

The orientation of the boom, orientation of the feed beam, direction of the hole, direction of the carrier and/or inclination of the carrier of the rock drilling apparatus may be used in the definition of the preset values. It is to be noted that it is possible to use a combination of two or more of the above illustrated methods, e.g. to carry out a second corrective automatic compensation correction if an orientation error is still detected after the support has been pushed on the ground. If the rock drilling apparatus drills more than one hole in the same position, turning of the boom causes a new compensation calculation for each hole but the information stored during the compensation of the first hole may be used as a help, which may decrease possible multiple presetting sequences.

When the deviations are determined, the control unit uses parameters stored in its memory. These parameters may be determined at the factory by turning the boom and the feed beam to different angles and storing the deviation values of each position. These values may then be stored in the memory of the control unit of the rock drilling apparatus. Once measured value tables may then be copied into the memories of similar rock drilling apparatuses without having to do the same every time.

It may be possible that the operator sets one or more parameters into the memory of the control unit on the basis of his or her experience. Also, the control unit may use adaptive methods and store information on previous drillings to be used later. Further, it is possible to use a network in order to divide the information collected with one rock drilling apparatus to other rock drilling apparatuses.

The change of the position of the carrier and/or support and support forces of the carrier are taken into account, whereby the changes of the positions of the joints and thus the movements of the boom and feed beam may be compensated for in the orientation. The changes in the position and/orientation of the rock drilling apparatus and thus also the feed beam are compensated by presetting the boom and the feed beam on the basis of the desired drilling direction into positions which deviate from their theoretical position so that, after the support has been pushed to the ground and the carrier, the boom and the feed beam have changed their positions, the feed beam is in its planned position and orientation.

This can be done by measuring the positions and orientations of the carrier, boom and feed beam by using the angle and position sensors, defining the real direction of the feed beam, and defining the deviations of the preset position and orientation. Then, by using these defined deviation values, the orientation may be compensated for in order to provide the drilling direction with acceptable accuracy. This can be done before or after the support is pushed to the ground and/or even during the pushing of the support to the ground.

According to another embodiment, mechanical and/or dynamical properties of different components of the rock drilling apparatus may be stored in the memory of the computer of the control unit 10 of the rock drilling apparatus and used in the compensation. The information on the mechanical and dynamical properties of the components may include their strength, their ability to bend according to the load affecting them, their weight etc. When the designed drilling direction has been given, for instance, in the drilling plan stored in the memory of the computer, or separately, the computer calculates different deviations of the components. Thereafter, the computer calculates the deviation of the feed beam in relation to the designed position. Then, during the positioning of the feed beam, the computer positions the feed beam and the boom in relation to the designed position by using the calculated deviation values so that it positions the boom and the feed beam to the opposite directions in relation to the calculated deviations.

The positioning of the feed beam and boom are done before the drilling unit has been used to push the support of the feed beam against the ground with the drilling force. When the drilling force is then applied to the components of the carrier, the boom and the feed beam may bend as usually but, as a result of the deviation calculation and the compensation, the feed beam 7 is after this in the direction which was designed for drilling.

The invention has been described here in the specification and in the figures only schematically. It can be implemented in many different ways and it can be applied to different kinds of rock drilling apparatuses. The basic idea is that the position and orientation changes affect the orientation of the feed beam and, thus, the orientation of the hole to be drilled are compensated for in advance, during the pushing of the support against the ground, or after that so that the feed beam at the end is in the desired direction.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A rock drilling apparatus comprising:

a carrier;

a drilling boom attached at a first end to the carrier;

a feed beam attached turnably to a second end of the drilling boom;

a drilling unit attached movably along the feed beam;

a support attached to the feed beam for supporting the drilling boom on the ground; and an arrangement for controlling the orientation of the boom and feed beam, wherein the arrangement is configured, on the basis of parameters affecting the orientation, to define the orientation change caused by forces resulting from driving the support onto the ground, the apparatus being configured to automatically adjust the orientation of the boom and feed beam so that the feed beam is in a desired direction before applying drilling force to compensate for the orientation change from the desired direction caused by forces resulting from supporting the drilling boom onto the ground.

2. The apparatus of claim 1, wherein the apparatus is configured to define the orientation change on the basis of one or more of the orientation of the boom, orientation of the feed beam, direction of the hole, and direction and inclination of the carrier.

3. The apparatus of claim 1, wherein the apparatus is configured to automatically change the orientation of the boom and feed beam before the support is driven onto the ground.

4. The apparatus of claim 3, wherein the apparatus is configured to automatically change the orientation of the boom and feed beam after the support is driven onto the ground.

5. The apparatus of claim 1, wherein the apparatus is configured to automatically change the orientation of the boom and feed beam during the driving of the support onto the ground.

6. A method for controlling the orientation of a feed beam of a rock drilling apparatus comprising a carrier, a drilling boom attached at a first end to the carrier, a feed beam attached turnably to a second end of the drilling boom, a drilling unit attached movably along the feed beam, and a support attached to the feed beam for supporting the drilling boom on the ground, the method comprising the steps of:

defining the orientation of the boom and feed beam;

defining, on the basis of parameters affecting an orientation change, the orientation change caused by forces resulting from driving the support onto the ground; and adjusting automatically the orientation of the boom and feed beam to compensate for the orientation change so that the feed beam is in a desired direction before applying drilling force to compensate for the orientation change caused by supporting the drilling boom onto the ground.

7. The method of claim 6, wherein the defining of the orientation change is performed on the basis of one or more of the orientation of the boom, orientation of the feed beam, direction of the hole, and direction and inclination of the carrier.

8. The method of claim 6, wherein the adjustment of the orientation of the boom and feed beam, to compensate for the orientation change, is done automatically by using a kinematic model of the apparatus.

9. The method of claim 6, wherein the orientation change is done on the basis of parameters defining the changes of the positions of the carrier, boom, and feed beam when the rock drilling apparatus is set to a support position for drilling after having driven the support into the ground.

10. The method of claim 6, wherein the adjustment of the orientation of the boom and feed beam is done before driving the support into the ground.

11. The method of claim 6, wherein the adjustment of the orientation of the boom and feed beam is done during the driving of the support onto the ground.

12. The method of claim 6, wherein the orientation is done by using the drilling data of the hole to be drilled.

* * * * *